US006565017B1

(12) United States Patent
Fath et al.

(10) Patent No.: US 6,565,017 B1
(45) Date of Patent: May 20, 2003

(54) FUEL INJECTION VALVE FOR A COMBUSTION ENGINE

(75) Inventors: Andreas Fath, Regensburg (DE); Wilhelm Frank, Bamberg (DE); Wendelin Klügl, Seubersdorf (DE); Eberhard Kull, Pfaffenhofen (DE); Günter Lewentz, Regensburg (DE); Hakan Yalcin, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/610,520

(22) Filed: Jul. 6, 2000

(30) Foreign Application Priority Data

Jul. 8, 1999 (DE) ..... 199 31 891

(51) Int. Cl.[7] ..... F02M 39/00

(52) U.S. Cl. ..... 239/533.3; 239/533.12; 239/584

(58) Field of Search ..... 239/533.1, 533.2, 239/533.3, 533.8, 533.9, 533.12, 583, 584; 251/50, 333

(56) References Cited

U.S. PATENT DOCUMENTS

| | | | | |
|---|---|---|---|---|
| 1,952,816 A | * | 3/1934 | Mock | 239/533.2 |
| 4,153,205 A | * | 5/1979 | Parrish, Jr. | 239/533.12 |
| 4,470,548 A | * | 9/1984 | Ushimura | 239/533.3 |
| 4,974,565 A | * | 12/1990 | Hashimoto et al. | 239/533.12 X |
| 5,163,621 A | * | 11/1992 | Kato et al. | 239/533.12 |
| 5,580,000 A | * | 12/1996 | Kiuchi et al. | 239/533.12 |
| 5,890,660 A | * | 4/1999 | Stevens | 239/533.3 |
| 6,047,905 A | * | 4/2000 | Honda et al. | 239/533.2 |

OTHER PUBLICATIONS

Published International Application No. 96/19661, dated Jun. 27, 1996.

* cited by examiner

*Primary Examiner*—Steven J. Ganey
(74) *Attorney, Agent, or Firm*—Laurence A. Greenberg; Werner H. Stemer; Ralph E. Locher

(57) ABSTRACT

Located between the frustoconical needle tip and the cylindrical needle shank of a nozzle needle of a fuel injection valve is a frustoconical needle portion, into which is introduced a peripheral groove. Through this kind of arrangement damping is capable of being set, depending on the position of the groove, during the axial movement of the nozzle needle.

9 Claims, 5 Drawing Sheets

Prior Art

FUEL INJECTION VALVE FOR A COMBUSTION ENGINE

BACKGROUND OF THE INVENTION

1. Field of the Invention

The invention relates to a fuel injection valve with a nozzle needle which is guided in a central guide bore of a nozzle body and has a peripheral sealing region having a sealing edge which, together with the valve seat of the nozzle body, forms a valve which is opened or closed, depending on the position of the nozzle needle, and controls the inflow of fuel to at least one injection hole in the nozzle tip of the nozzle body.

In injection systems, fuel is injected under high pressure into the combustion space of an internal combustion engine via a fuel injection valve.

2. Description of the Related Art

WO 96/19661 discloses a fuel injection valve having a nozzle body with a central guide bore, in which a nozzle needle is guided. The valve opens as a result of the axial movement of the nozzle needle, said valve being formed by the sealing edge of the nozzle needle and the conical valve seat at the nozzle tip of the nozzle body. The valve thus controls the flow of fuel to the injection holes which are introduced into the nozzle tip. A step in the form of a peripheral groove is introduced below the sealing edge of the nozzle needle, in order to prevent the change in the valve seat diameter which is caused by wear.

When the valve closes, the sealing edge of the nozzle needle strikes the conical valve seat sharply, thus giving rise to pronounced mechanical stress on the nozzle body which may lead to a curtailed service life of the latter.

SUMMARY OF THE INVENTION

The object of the invention is to reduce the mechanical stress on the nozzle body which occurs during the closing of the valve.

The object of the invention is achieved by means of the features of the independent patent claim.

Advantageous embodiments of the invention are specified in the dependent claims.

In the invention, the nozzle needle has, between its frustoconical nozzle needle tip and its cylindrical needle shank, a frustoconically designed body portion which, at its transition to the nozzle needle tip, has a sealing edge which, together with the conical valve seat of the nozzle tip of a nozzle body, forms a valve. The conical valve seat forms, with the frustoconical body portion of the nozzle needle, an angle the sides of which meet at the sealing edge and which forms a small angle in the region of a few degrees. During the closing of the valve, that is to say when the sealing edge strikes the conical valve seat, the fuel in the gap between the body portion of the nozzle needle and the conical valve seat is pressed out, with the result that the closing action is damped.

The peripheral gap between the valve seat and the body portion is partially enlarged by means of a recess in the nozzle needle or in the nozzle body, with the result that the effect of damping the closing action can be set. The recess is designed as a peripheral groove in the nozzle needle or in the nozzle body. The damping effect can be set, depending on the position of the recess, that is to say on the axial position of the recess and on the size of the recess.

In one embodiment, the peripheral groove is made directly at the sealing edge of the nozzle needle, with the result that, in addition to the damping effect, the valve seat diameter does not change, or changes only insignificantly, when the nozzle needle undergoes wear at the sealing edge.

In a further embodiment, a frustoconical body portion of the nozzle needle is arranged between the peripheral groove and the sealing edge, as a result of which the damping effect can be set, depending on the axial length of this body portion.

In a further embodiment, the peripheral groove has a first and a second groove portion which is arranged in the direction of the sealing edge or of the shank bore, the first groove portion being of cylindrical design. This makes it possible to manufacture the groove in a simple way within the respective body portion of the nozzle needle. Additionally, when the cylindrical second groove portion is arranged directly at the sealing edge, the effect of wear on the valve seat diameter is only slight.

Furthermore, the recess is introduced as a peripheral groove into the inner wall of the valve seat of the nozzle body.

In a further embodiment, a further peripheral groove is introduced into the frustoconical nozzle needle tip and serves for guiding the nozzle needle radially during the opening and closing of the valve.

The nozzle body is advantageously designed in the form of a seat hole nozzle, the injection holes of which are located in the region of the conical valve seat.

Other features which are considered as characteristic for the invention are set forth in the appended claims.

Although the invention is illustrated and described herein as embodied in a fuel injection valve for an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
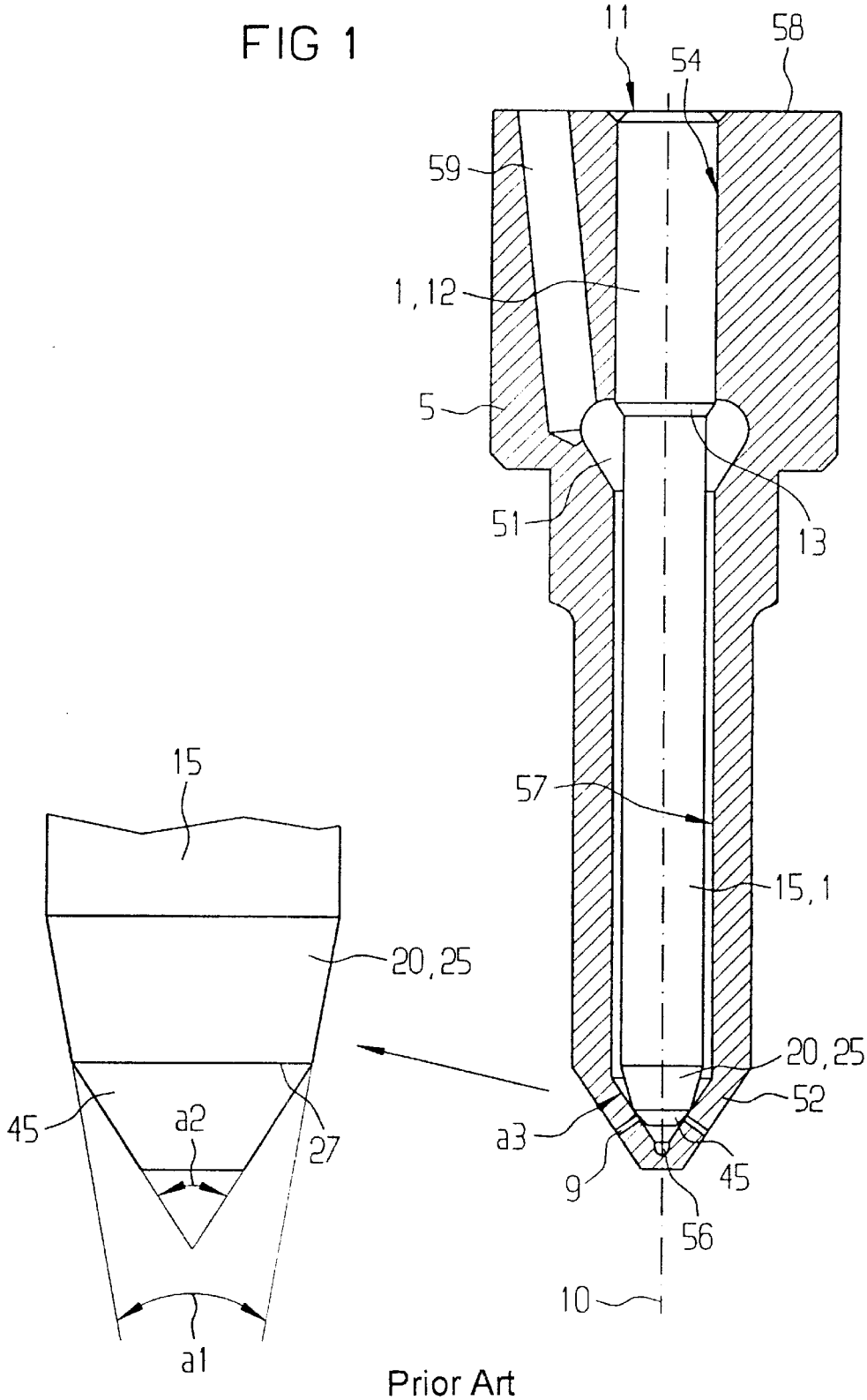
FIG. 1 shows a longitudinal section through the nozzle body of a fuel injection valve with a nozzle needle.

FIG. 1 shows, as prior art, a longitudinal section through a fuel injection valve with an essentially rotationally symmetric nozzle body 5, in the central guide bore 54 of which is guided axially a rotationally symmetric nozzle needle 1. Starting from the orifice of the guide bore 54 in the end face 58 of the nozzle body 5, the guide bore 54 merges into a radially widening pressure chamber 51 which thereupon narrows again, a shank bore 57 and a conically tapering valve seat 55 with a valve seat angle a3 which terminates in a pocket 56. An inflow duct 59 is arranged laterally in relation to the guide bore 54 and opens laterally into the pressure chamber 51. At least one injection hole 9 is introduced into the tip of the nozzle body in the region of the valve seat 55.

The nozzle needle 1 is subdivided axially into various cylindrical or frustoconical body portions, the diameters of which decrease from the rear side 11 of the nozzle needle 1 in the direction of the flattened needle tip 45. The nozzle needle 1 is subdivided, from its rear side 11 in the direction of its nozzle needle tip, into

- a cylindrical guide shank 12 which is guided in the guide bore 54 and has approximately the diameter of the guide bore 54,
- a frustoconical thrust shoulder 13 level with the pressure chamber 51,
- a cylindrical needle shank 15 level with the shank bore 57 of the nozzle body 5, in another embodiment the needle shank 15 being capable of having a noncylindrical cross section, at least in part of its length, for example being in the shape of a uniform polygon,
- a frustoconical needle portion 20, 25 with a first frustoconical angle a1, and
- a frustoconical needle tip 45 having a flattened tip, with a second frustoconical angle a2, which is larger than the first frustoconical angle a1.

The transition between the needle portion 20, 25 and the needle tip 45 forms a peripheral edge 27, referred to below as a sealing edge 27, which, together with the conical valve seat 55, forms a valve 27, 55 which, depending on the axial position of the nozzle needle 1 in the nozzle body 5, controls the flow of fuel to the injection holes 9 which are arranged below the sealing edge 27 in the direction of the needle tip 45.

The fuel injection valve functions as follows:

The nozzle needle 1 is subjected on its rear side 11 to a force which is aimed in the direction of the needle tip 45. The force may be transmitted to the rear side 11 of the nozzle needle 1 directly by an actuator, for example a piezoelectric or electromagnetic actuator, or indirectly via a hydraulic servovalve. Fuel flows via the inflow duct 59, the pressure chamber 51 and the shank bore 57 and, depending on the valve position of the valve 27, 55, is injected through the injection holes 9 into the combustion chamber of an internal combustion engine. The flow of fuel to the injection holes 9 is controlled, depending on the axial position of the nozzle needle 1. The movement of the nozzle needle 1 and therefore its position depend essentially on the fuel pressure in the pressure chamber 51 and on the force acting on the rear side 11 of the nozzle needle 1.

During the closing operation of the valve 27, 55, that is to say during the movement of the nozzle needle 1 axially in the direction of the tip of the nozzle body 5, the sealing edge 27 butts onto the conical valve seat 55, with the result that the valve seat 55 undergoes wear (seat wear). The seat wear depends on the intensity with which the sealing edge 27 strikes the valve seat 55 and on the shaping of the sealing region 28 which is formed by the sealing edge 27, the portion of the nozzle tip 45 near the sealing edge 27 and the valve seat 55. When the nozzle needle 1 strikes the valve seat 55, the nozzle body 5 is deformed elastically, so as to give rise to the dynamic sealing region 28 which serves for distributing the dynamic force arising during impact to the valve seat 55 uniformly over a large area, thus resulting in a lower load per unit area in the material.

The angle difference a (see FIG. 2) between the valve seat angle a3 and the second frustoconical angle a2 is small, and it is at most a few degrees and preferably in the range between 0.15 and 5°. Due to the small angle difference a, shortly before the sealing edge 27 strikes the valve seat 55 the fuel is pressed out of the needle portion 20, 25 and the valve seat 55, thus leading to a damping of the closing movement, with the result that the force with which the sealing edge 27 strikes the valve seat 55 and therefore the wear are reduced.

FIGS. 2 to 5 illustrate various exemplary embodiments of that part of the fuel injection valve from FIG. 1 which extends from the shank bore 57 to the tip of the nozzle body 5, together with different embodiments of the nozzle needle 1 and of the nozzle body 5. Functionally identical body portions have been given the same reference symbols.

Figure 2:
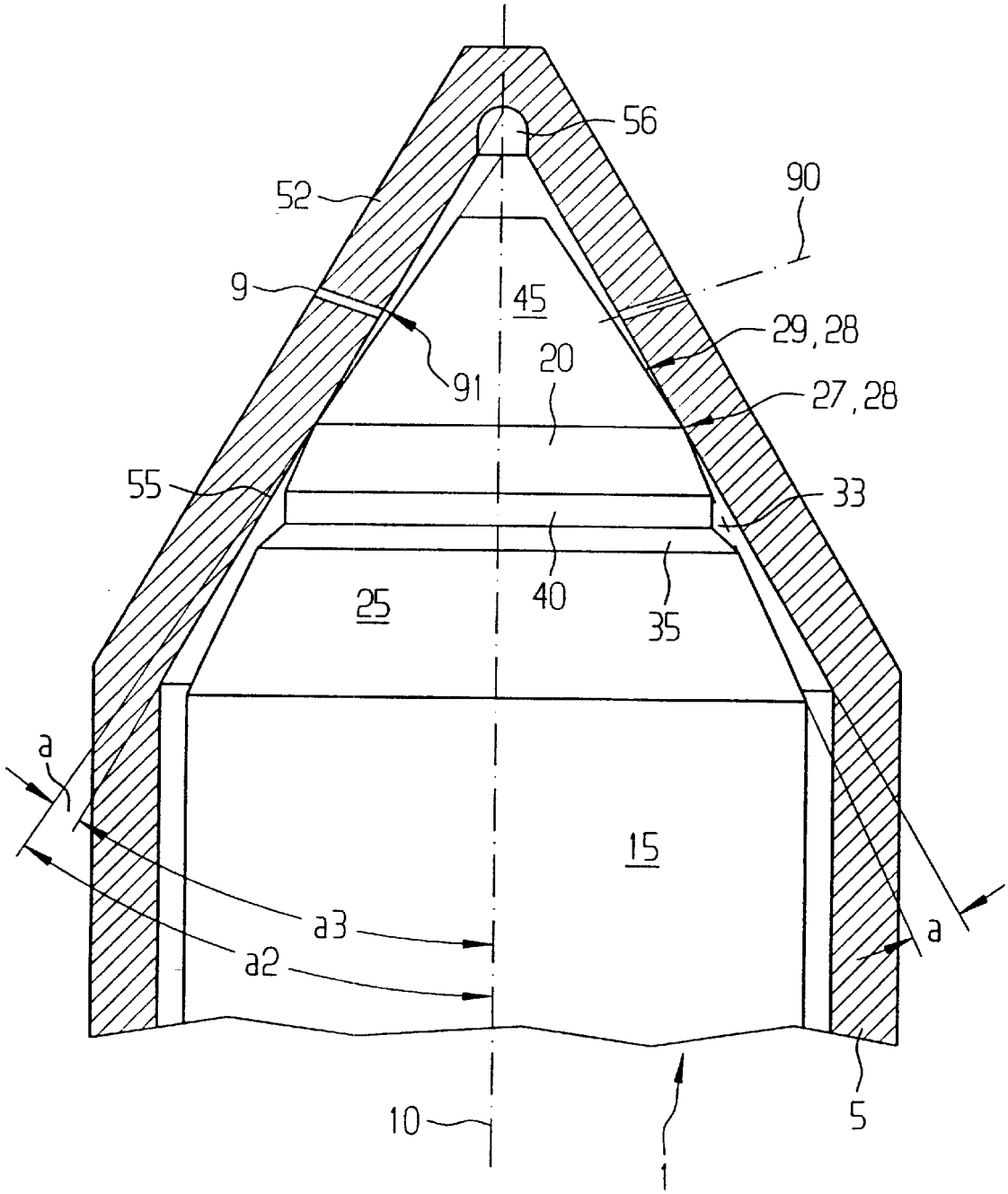
FIG. 2 shows a further exemplary embodiment of the nozzle body and of the nozzle needle.

In contrast to FIG. 1, in FIG. 2 a peripheral groove 33 is introduced into the needle portion 20, 25 which is thereby subdivided into a first and a second needle portion 20, 25 in the direction of the sealing edge 27 or of the needle shank 15. The damping, referred to in FIG. 1, of the closing movement is capable of being set by means of the groove 33 and of thereby being adapted to customer-specific requirements.

The damping depends on:

- the angle difference a,
- the axial position of the groove 33 in the needle portion 20, 25,
- the volume which the fuel occupies in the groove 33,
- the maximum clearance between the wall of the groove 33 and the surface of the valve seat 55, and
- the shape of the groove.

During the closing movement, due to the small angle difference a, shortly before the sealing edge 27 strikes the valve seat 55 the fuel is pressed out of the damping gap between the needle portion 20, 25 and the valve seat 55, while, in addition, due to the formation of the groove 33, pressure waves and resonances occur in the damping gap, which, depending on

- the angle difference a,
- the closing speed of the nozzle needle 1,
- the fuel pressure,
- the axial position of the groove 33 in the needle portion 20, 25,
- the volume which the fuel occupies in the groove 33,
- the maximum clearance between the wall of the groove 33 and the surface of the valve seat 55, and
- the shape of the groove 33, advantageously lead to a superproportional intensification or attenuation of the damping of the closing movement.

Figure 3:
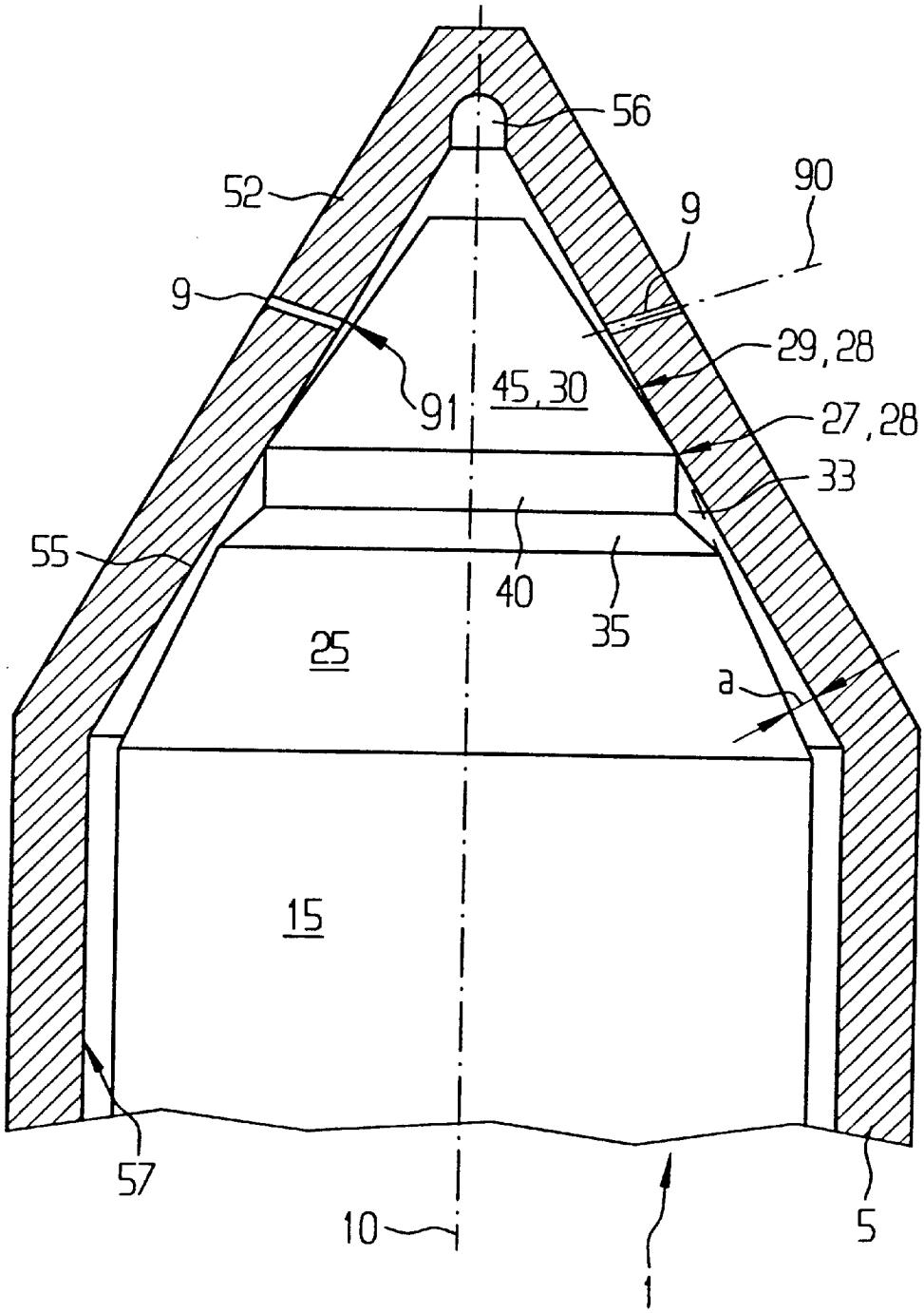
FIG. 3 shows a longitudinal section through part of the nozzle body of a fuel injection valve with a nozzle needle.

In contrast to FIG. 2, in FIG. 3 the peripheral groove 33 is introduced into the needle portion 20 directly at the sealing edge 27, as a result of which, when wear occurs, the valve seat diameter changes only slightly, or does not change at all, depending on the shape of the groove 33.

In a further exemplary embodiment, the groove 33 is introduced into the needle portion 25 directly at the transition to the needle shank 15, as a result of which the effective axial length of the needle portion 25 and therefore of the damping gap is shortened and damping can thus be set in a defined manner.

Furthermore, introducing a groove 33 into the needle portion 20, 25 of the nozzle needle 1 in the way described in the previous figures brings about a radial stabilization of the nozzle needle 1, since the fuel is distributed quickly and uniformly in the groove 33 and generates a radial stabilizing force on the nozzle needle 1.

The groove 33 described in the previous figures is preferably subdivided into a first, frustoconical groove portion 35 and a second, cylindrical groove portion 40 which are arranged respectively in the direction of the needle shank 15 and of the needle tip 45. When the groove 33 is arranged with its second, cylindrical groove portion 40 directly below the sealing edge 27 (see FIG. 3), a valve seat diameter independent of wear is advantageously obtained.

Figure 4:
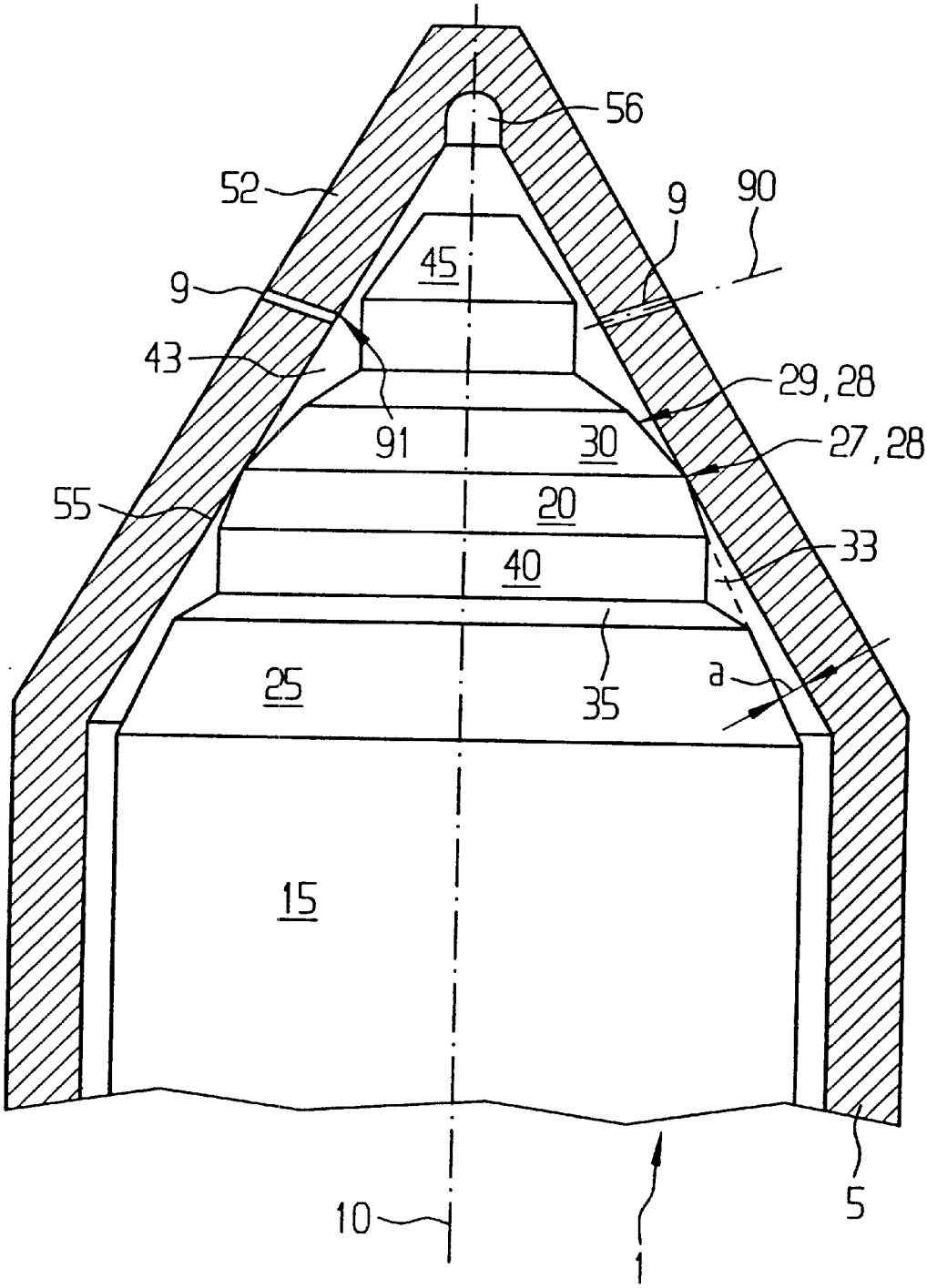
FIG. 4 shows a further exemplary embodiment of the nozzle body and of the nozzle needle.

In contrast to FIG. 2, in FIG. 4 a further peripheral groove 43 is introduced into the frustoconical needle tip 30, 45 and subdivides the needle tip into a first and a second body portion 30, 45.

The axes 90 of the injection holes 9 open into the further groove 43 when the valve 27, 55 is closed and preferably also when the valve 27, 55 is fully open with a maximum deflection of the nozzle needle 1.

Preferably, the edge 91, located in the direction of the nozzle tip 45, of that orifice of the injection hole 9 which is located on the inside of the nozzle body 5 is arranged level with the second groove portion 40 when the nozzle needle 1 is in its closing position, preferably also when the nozzle needle 1 has maximum deflection.

During the opening of the nozzle needle 1, pressure compensation takes place at the further groove 43 of the nozzle needle 1, and, due to the fuel pressure and the flow of fuel toward the nozzle needle 1, a force directed radially to the longitudinal axis 10 of the latter is exerted, which counteracts a radial deviation of the nozzle needle 1, with the result that the nozzle needle 1 is radially stabilized and centered in the middle.

The introduction of two peripheral grooves 33, 43 into the nozzle needle 1 results in mutually intensifying combination effects with regard to the radial stabilization of the nozzle needle 1 during the opening and closing of the latter.

Figure 5:
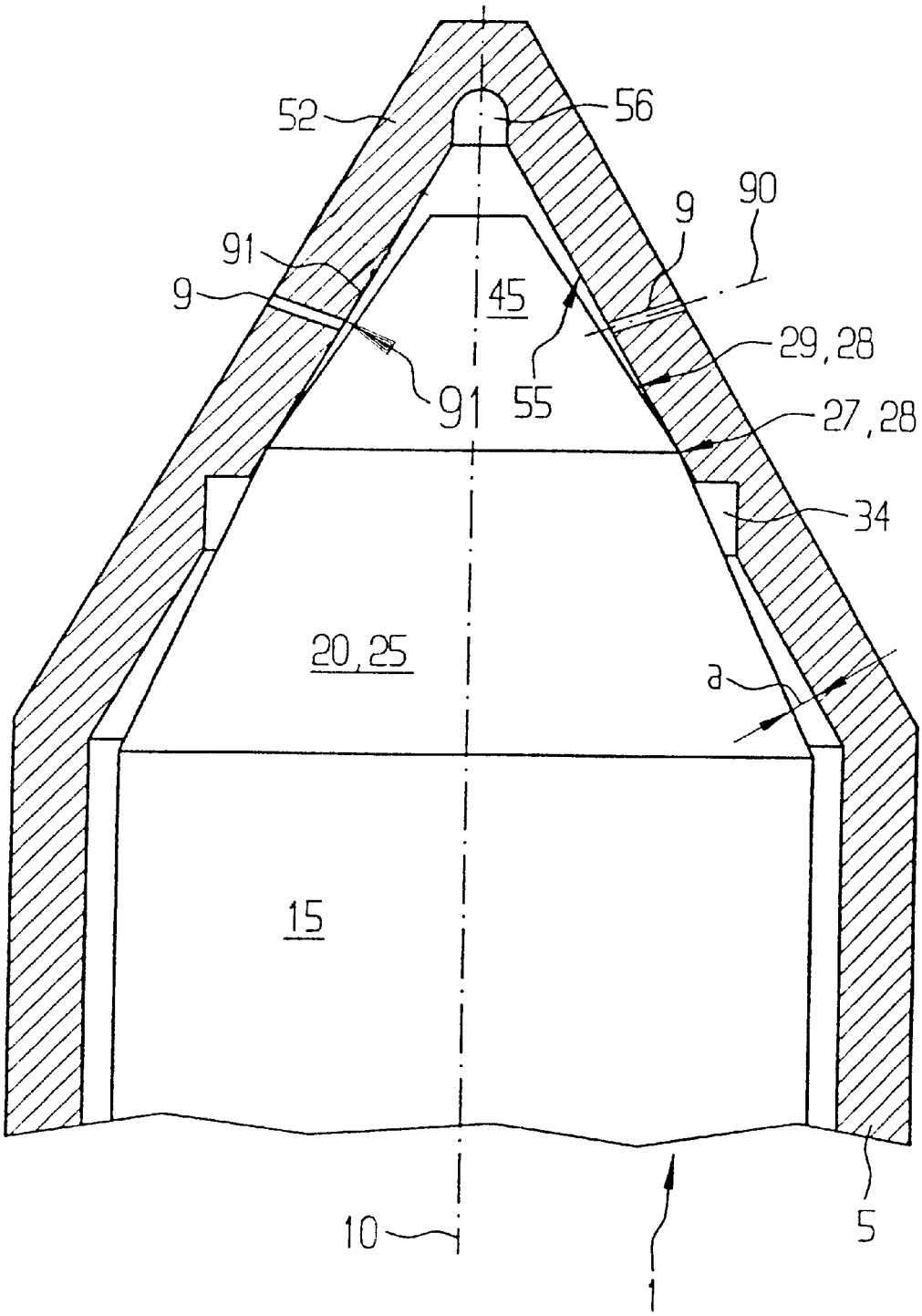
FIG. 5 shows a further exemplary embodiment of the nozzle body and of the nozzle needle.

In contrast to FIG. 1, in FIG. 5 a peripheral wall groove 34 is introduced level with the needle portion 20, 25 and has the same functionality as the groove 33 described in the previous figures. Depending on the manufacturing methods used, the manufacturing costs can thereby be reduced.

The maximum clearance, preferred in the exemplary embodiments described in the previous figures, between the wall of the groove 33 and the inner wall of the nozzle body 5 or between the wall of the wall groove 34 and the needle portion 20, 25 is in the range of 0.01 to 0.1 mm.

What is claimed is:

1. A fuel injection valve, comprising:

a seat hole nozzle formed with a central guide bore, a conical valve seat, and a fuel injection hole formed in said conical valve seat;

a nozzle needle having a needle shank guided in said central guide bore of said seat hole nozzle, and a frustoconical needle portion having a peripheral sealing region with a sealing edge defining, together with said valve seat of said seat hole nozzle, a valve to be opened or closed in dependence on a position of said nozzle needle, for controlling a flow of fuel to said fuel injection hole; and said nozzle needle and an inner wall of said seat hole nozzle forming a gap therebetween, and one of said seat hole nozzle and said nozzle needle having a recess formed therein in the region of said frustoconical needle portion within said conical valve seat axially between said sealing edge and said needle shank for enlarging said gap.

2. The fuel injection valve according to claim 1, wherein said recess is a circumferential groove formed in said nozzle needle.

3. The fuel injection valve according to claim 2, wherein said circumferential groove is directly adjacent said sealing edge.

4. The fuel injection valve according to claim 2, wherein said frustoconical needle portion has a frustoconical first needle portion between said circumferential groove and said sealing edge.

5. The fuel injection valve according to claim 4, wherein said frustoconical needle portion has a frustoconical second needle portion between said circumferential groove and said needle shank.

6. The fuel injection valve according to claim 2, wherein said frustoconical needle portion is formed between said circumferential groove and said needle shank.

7. The fuel injection valve according to claim 2, wherein said circumferential groove has a substantially cylindrical first groove portion in a vicinity of said sealing edge and a second groove portion remotely of said sealing edge.

8. The fuel injection valve according to claim 1, wherein said recess is a circumferential groove formed in said inner wall of said seat hole nozzle.

9. The fuel injection valve according to claim 1, wherein said nozzle needle is formed with a peripheral guide groove between said needle tip and said sealing edge.

* * * * *